US010647553B2

(12) United States Patent
Martin et al.

(10) Patent No.: US 10,647,553 B2
(45) Date of Patent: May 12, 2020

(54) MOBILE CRANE AND METHOD FOR ANGLING A MAIN JIB EXTENSION RELATIVE TO A MAIN JIB OF A MOBILE CRANE

(71) Applicant: Terex Global GmbH, Schaffhausen (CH)

(72) Inventors: Michael Martin, Illingen (DE); Traugott Fess, Bechhofen (DE); Roland Kuhn, St. Ingbert (DE)

(73) Assignee: Terex Global GmbH, Schaffhausen (CH)

( * ) Notice: Subject to any disclaimer, the term of this patent is extended or adjusted under 35 U.S.C. 154(b) by 0 days.

(21) Appl. No.: 15/774,916

(22) PCT Filed: Nov. 8, 2016

(86) PCT No.: PCT/EP2016/077000
§ 371 (c)(1),
(2) Date: May 9, 2018

(87) PCT Pub. No.: WO2017/081019
PCT Pub. Date: May 18, 2017

(65) Prior Publication Data

US 2018/0327234 A1 Nov. 15, 2018

(30) Foreign Application Priority Data

Nov. 10, 2015 (DE) ..... 10 2015 119 381

(51) Int. Cl.
*B66C 23/70* (2006.01)
*B66C 23/68* (2006.01)
*B66C 23/82* (2006.01)

(52) U.S. Cl.
CPC ..... *B66C 23/702* (2013.01); *B66C 23/68* (2013.01); *B66C 23/82* (2013.01); *B66C 23/701* (2013.01); *B66C 2700/0392* (2013.01)

(58) Field of Classification Search
CPC ..... B66C 23/68; B66C 23/701; B66C 23/702; B66C 23/82
See application file for complete search history.

(56) References Cited

U.S. PATENT DOCUMENTS 3,085,695 A * 4/1963 Miller ..... B66C 23/70 212/177
4,394,941 A 7/1983 Privat
(Continued)

FOREIGN PATENT DOCUMENTS

CN 1138005 A 12/1996
CN 2364010 Y 2/2000
(Continued)

OTHER PUBLICATIONS

JPS-60100390 Machine Translation (Year: 1985).*
(Continued)

*Primary Examiner* — Michael R Mansen
*Assistant Examiner* — Juan J Campos, Jr.
(74) *Attorney, Agent, or Firm* — Gardner, Linn, Burkhart & Ondersma LLP

(57) ABSTRACT

A mobile crane having a main jib that is mounted thereupon for luffing and that can be oriented by means of a luffing cylinder, and a main jib extension which is detachably connected to a main jib head of the main jib by upper and lower bolts, it being possible to angle the main jib extension about a luffing axis relative to the main jib proceeding from a base position following release of the upper or lower bolts and using an angle drive, the angle drive engaging with a foot of the main jib extension, a maximum angling angle
(Continued)

being delimited by an adjustable angling plate, and the angling plate engaging with the foot of the main jib extension and the main jib head. The angle drive is a component of an angling plate in the form of a combi-angling plate.

16 Claims, 8 Drawing Sheets

(56) References Cited

U.S. PATENT DOCUMENTS

| | | | | | |
|---|---|---|---|---|---|
| 4,653,655 | A * | 3/1987 | Rathi | B66C 23/702 212/177 | |
| 4,828,124 | A | 5/1989 | Iga | | |
| 5,842,587 | A * | 12/1998 | Wanek | B66C 23/82 212/177 | |
| 9,056,752 | B2 | 6/2015 | Muller et al. | | |
| 9,090,436 | B2 | 7/2015 | Franzen et al. | | |
| 9,272,883 | B2 | 3/2016 | Behnke | | |
| 2005/0011850 | A1* | 1/2005 | Hinrichs | B66C 23/702 212/300 | |
| 2005/0098524 | A1* | 5/2005 | Irsch | B66C 13/18 212/300 | |
| 2010/0213152 | A1* | 8/2010 | Martin | B66C 23/18 212/177 | |
| 2010/0294738 | A1* | 11/2010 | Martin | B66C 23/344 212/347 | |
| 2010/0329773 | A1* | 12/2010 | Martin | B66C 23/702 403/3 | |
| 2017/0066632 | A1 | 3/2017 | Hegewald | | |
| 2018/0044149 | A1 | 2/2018 | Weckbecker et al. | | |
| 2018/0339889 | A1 | 11/2018 | Kuhn et al. | | |
| 2018/0346291 | A1 | 12/2018 | Martin et al. | | |
| 2018/0346292 | A1 | 12/2018 | Kuhn et al. | | |

FOREIGN PATENT DOCUMENTS

| | | | | |
|---|---|---|---|---|
| CN | 101628691 | A | 1/2010 | |
| CN | 101687618 | A | 3/2010 | |
| CN | 201458603 | U | 5/2010 | |
| CN | 101830403 | A | 9/2010 | |
| CN | 102862921 | A | 1/2013 | |
| CN | 103359636 | A | 10/2013 | |
| CN | 102602825 | B | 7/2014 | |
| DE | 291531 | A5 | 7/1991 | |
| DE | 202004020760 | U1 | 1/2006 | |
| DE | 10321493 | B4 | 7/2006 | |
| DE | 102009010452 | A1 | 9/2010 | |
| DE | 102012023814 | A1 | 6/2014 | |
| DE | 102014003831 | A1 | 9/2015 | |
| EP | 1081088 | A1 | 3/2001 | |
| EP | 2253576 | A1 | 11/2010 | |
| FR | 2075866 | A1 | 10/1971 | |
| FR | 2719574 | A1 | 11/1995 | |
| GB | 1470488 | A | 4/1977 | |
| GB | 2081210 | A | 2/1982 | |
| JP | S60100390 | * | 9/1985 | B66C 23/68 |
| JP | S6346465 | Y2 | 12/1988 | |
| JP | H09104588 | A | 4/1997 | |

OTHER PUBLICATIONS

JP-H09104588 Machine Translation (Year: 1997).*

International Search Report of the International Searching Authority from corresponding Patent Cooperation Treaty (PCT) Application No. PCT/EP2016/077000, indicated completed on Feb. 22, 2017.

Written Opinion of the International Searching Authority from corresponding Patent Cooperation Treaty (PCT) Application No. PCT/EP2016/077000, indicated completed on Feb. 22, 2017.

International Preliminary Examination Report from corresponding Patent Cooperation Treaty (PCT) Application No. PCT/EP2016/077000, dated Oct. 11, 2017.

Preliminary Report on Patentability of the International Searching Authority in English from corresponding Patent Cooperation Treaty (PCT) Application No. PCT/EP2016/077000, completed Apr. 3, 2018.

* cited by examiner

MOBILE CRANE AND METHOD FOR ANGLING A MAIN JIB EXTENSION RELATIVE TO A MAIN JIB OF A MOBILE CRANE

The present application claims the priority benefits of International Patent Application No. PCT/EP2016/077000, filed Nov. 8, 2016, and claims benefit of German patent application DE 10 2015 119 381.7, filed Nov. 10, 2015.

BACKGROUND OF THE INVENTION

The invention relates to a mobile crane with a main jib luffably mounted thereon and able to be raised via a luffing cylinder, and with a main jib extension releasably connected to a main jib head of the main jib via upper and lower bolts, the main jib extension, starting from a basic position after release of the upper or lower bolts, is able to be angled about a luffing axis relative to the main jib by means of an angling drive, the angling drive is a component of a combi-angling plate which delimits a maximum angling angle in a mechanically adjustable manner, wherein the angling drive engages on a foot of the main jib extension and the main jib head and the combi-angling plate consists of a sliding plate, a guiding plate and the angling drive.

The invention also relates to a method for angling a main jib extension relative to a main jib of a mobile crane.

German utility model DE 20 2004 020 760 U1 already discloses a mobile crane with a main jib and a main jib extension fastened to its main jib head. The main jib extension is luffable from a basic position, in which the main jib extension is orientated with its longitudinal direction as an extension of the longitudinal direction of the main jib, into a 20° position and a 40° position. In a conventional manner, the main jib extension is releasably fastened to the main jib head via two lower bolts disposed in the region of bottom chords of the main jib extension and two upper bolts disposed in the region of top chords of the main jib extension. In order to be able to luff the two lower bolts serving as a luffing axis out of the basic position, in a first step the two upper bolts are pulled and in a second step, by means of hydraulic luffing cylinders which engage on the main jib head and on the main jib extension, the luffing of the main jib extension is effected. The insertion and pulling of the two upper bolts is effected in each case via a hydraulic bolting cylinder. In order to power the luffing cylinders and the bolting cylinders an autonomous hydraulic assembly is disposed at the lower end of the main jib extension. It is possible to use e.g. a diesel engine or an electric motor, in each case with an associated hydraulic pump, as the hydraulic assembly.

The German patent DE 103 21 493 B4 discloses a mobile crane with a main jib extension and an angling plate. The angling plate is designed as a mechanically fixable telescoping device with a tubular guiding plate and a sliding plate which is guided and can be extended therein and which is likewise tubular. The guiding plate comprises stop openings for receiving bolts which ensure support of the sliding plate at its lower end and therefore permit a preselected length for the angling plate and therefore the angular adjustment of the main jib extension. The angling plate is disposed in the region of a bottom chord of the main jib and of the main jib extension. The desired angling is achieved by lifting the main jib, whereby the angling plate is shortened until the sliding plate contacts the bolts and is supported thereon.

Furthermore, European patent application EP 2 253 576 A1 discloses another embodiment of an angling plate for angling a main jib extension of mobile cranes. The angling plate formed from two angle levers comprises, in its basic position, which corresponds to a 0° position of the main jib extension to the main jib, a plurality of pairs of aligned stop openings for bolts. By selecting a pair of stop openings for the bolts the length of the angling plate can be varied and the main jib extension can be fixed in different angular positions, preferably 0°, 20° and 40°. The actual angling movement of the main jib extension is effected by means of a hoist located on the crane or next to the crane.

SUMMARY OF THE INVENTION

The object of the invention is to create a mobile crane and a method for angling a main jib extension relative to a main jib of a mobile crane, with which the angling of the main jib extension is simplified.

In accordance with the invention, in the case of a mobile crane with a main jib luffably mounted thereon and able to be raised via a luffing cylinder and with a main jib extension releasably connected to a main jib head of the main jib via upper and lower bolts, the main jib extension, starting from a basic position, is able to be angled about a luffing axis relative to the main jib by means of an angling drive, the angling drive is a component of a combi-angling plate which delimits a maximum angling angle in a mechanically adjustable manner, wherein the angling drive engages on a foot of the main jib extension and the main jib head and the combi-angling plate consists of a sliding plate, a guiding plate and the angling drive, a simplification is achieved in that the combi-angling plate can be modified in length via the angling drive, and the angling drive drivingly engages on the one hand on the sliding plate and on the other hand on the guiding plate and the sliding plate can be displaced in a length-modifiable manner relative to the guiding plate via the angling drive, In an advantageous manner, a known passive mechanically delimiting angling plate is therefore converted into a hydraulically supported combi-angling plate which also provides the mechanical delimitation. By the integration of the angling drive into the combi-angling plate no additional force-introducing points on the main jib head or the main jib extension are required. The angling per se takes place predominantly on the ground or the deposit position of the main jib and so it is not necessary to work above the upper edge of the mobile crane. The invention makes it possible to angle the main jib extension in the case of a mobile crane standing on even ground and with a horizontally orientated telescopic jib. The last part of the luffing-up of the main jib extension into a 20°- or a 40°-position is assisted by the luffing cylinder of the main jib. Since the extension travel of the hydraulic cylinder of the angling drive can be freely selected, in the case of extension travel which has been selected to be longer, the angling drive can be designed relatively independently of the terrain.

Since the combi-angling plate engages in the region of the foot of the main jib extension no fork head offset, which compensates a deformation of the main jib extension, is required between the main jib and main jib extension. This is particularly important in the case of long narrow jib systems. Also for this reason no auxiliary cylinder is required by means of which a fork head offset has to be compensated for.

In order to be able to use the combi-angling plate as a passive or active angling plate as required, the angling drive is releasably fastened to the sliding plate.

Space is particularly saved by the sliding plate being displaceably guided in the guiding plate and the angling drive being disposed in the guiding plate. Provision is also made that, by means of a stop bolt, a maximum displacement of the sliding plate relative to the guiding plate can be delimited.

Provision is particularly made that the luffing axis is formed in the region of the top chord of the main jib extension or of the bottom chord of the main jib extension and the combi-angling plate is disposed in the region of the bottom chord of the main jib extension or of the top chord of the main jib extension.

Provision is preferably made that the combi-angling plate on the one hand engages on the main jib head and on the other hand on the main jib extension. In this case in particular the angling drive is designed in such a way that the main jib extension can be lifted and lowered in a pivoting manner about the luffing axis against the effect of the gravitational force of the main jib extension.

It is particularly advantageous that the angling drive is designed as a hydraulic cylinder with a housing and rod.

In a preferred implementation provision is made that two combi-angling plates are disposed in parallel and spaced apart from one another and the two combi-angling plates are preferably disposed in corner regions of the main jib extension. In an advantageous manner the combi-angling plate replaces a part of the top chord or of the bottom chord of the main jib extension in the region of the foot of the main jib extension.

In a particular manner, the sliding plate is pivotably mounted on the main jib head, the guiding plate is pivotably mounted on the main jib extension and by means of an insertable stop bolt a maximum displacement of the sliding plate in the guiding plate can be delimited.

In accordance with the invention in the case of a method for angling a main jib extension relative to a main jib of a mobile crane, in particular of an above-described mobile crane, wherein the main jib is luffably mounted on the mobile crane and can be raised via a luffing cylinder, the main jib extension is releasably connected to a main jib head of the main jib, an angling drive engages on a foot of the main jib extension and on a main jib head, a simplification is achieved in that by means of the angling drive, which is a component of a combi-angling plate which delimits a maximum angling angle in a mechanically adjustable manner and can be modified in length via the angling drive, the main jib extension, starting from a basic position, can be lifted about a luffing axis relative to the main jib until a locking bolt for a 0° position within the combi-angling plate is relieved, then the locking bolt is removed, then, unless it has happened already, the angling drive is drivingly coupled to the combi-angling plate, by means of the angling drive the main jib extension is lowered until the maximum angling position is reached or a head of the main jib extension comes into contact with a ground surface, the angling drive is drivingly separated from the combi-angling plate and, when the maximum angling position has not yet been reached, by means of raising the main jib, the main jib extension is angled until the desired angling angle is reached. In relation to the advantages associated herewith, reference is made to the statements previously given for the mobile crane.

Provision is preferably made that, after the separation of the angling drive, a stop bolt is inserted into the combi-angling plate and the maximum extension of the combi-angling plate and therefore the maximum angling angle, preferably 20° or 40°, is delimited by the stop bolt. In association with the present invention, a mobile crane is understood to be both a movable telescopic crane and also a movable crawler crane with a lattice mast jib.

The invention is explained in more detail hereinunder with the aid of an exemplified embodiment illustrated in the drawings.

DESCRIPTION OF THE PREFERRED EMBODIMENTS

Figure 1:
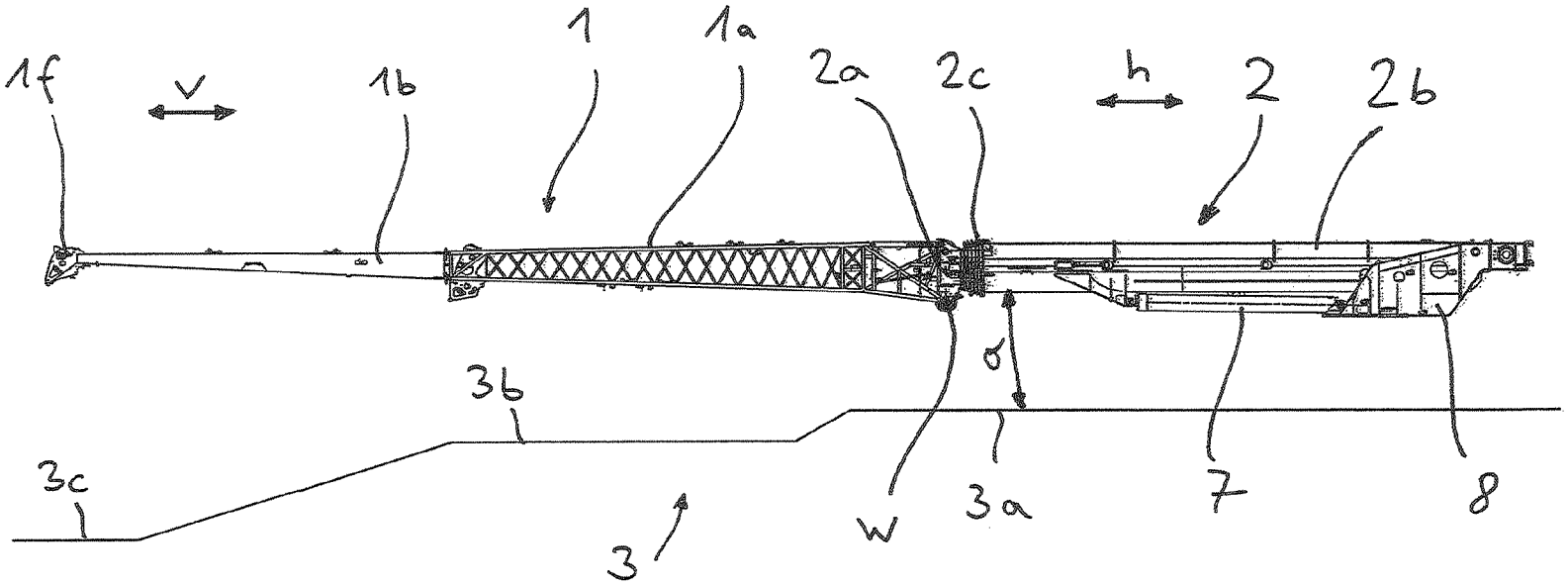
FIG. 1 is a side view of a main jib extension in a basic position on a main jib.

FIG. 1 illustrates a side view of a main jib extension 1 in a basic position on a main jib 2. The main jib 2 is designed as a telescopic jib with a basic box 2*b* and corresponding telescopic sections 2*c*. At the free end of the innermost telescopic section 2*c* a main jib head 2*a* is provided. The main jib 2 is a component of a telescopic crane, not illustrated, and is, in a conventional manner, able to be raised via a hydraulic luffing cylinder 7 which is supported on a superstructure 8 of the telescopic crane. The superstructure 8 is indicated in FIG. 1 only by a frame part thereof. FIG. 1 shows the main jib extension 1 and the main jib 2 in a so-called stored position in which the main jib extension 1 is orientated with its longitudinal direction v and the main jib 2 is orientated with its longitudinal direction h substantially horizontally. A so-called luffing angle a of the main jib 2 relative to the superstructure 8 therefore amounts to 0° in the stored position. The luffing angle a describes the raising of the main jib 2 relative to the superstructure 8. The main jib extension 1 is releasable fastened to the main jib head 2*a* via a bolt connection. The main jib extension 1 can be used temporarily or continuously with the telescopic crane in order to reach an even greater overall jib length exceeding the greatest jib length of the main jib 2.

This main jib extension 1 is divided into a basic jib 1 designed as a girder mast and conventionally being of latticework tubular construction, and a tip 1*b* adjoining same and designed as a box jib. In FIG. 1, the main jib 2 and the main jib extension 1 are located in a 0° position or basic position in which the longitudinal direction h of the main jib 1 and the longitudinal direction v of the main jib extension 1 are aligned with one another or extend in parallel with one another. A corresponding angling angle b is thus 0°. The main jib extension 1 is luffable about a luffing axis w with respect to the main jib 2, said spindle being formed from a lower roller head spindle. In this basic position, the main jib extension 1 is spaced apart from a ground surface 3 with first to third ground levels 3*a* to 3*c* and is therefore supported by the main jib 2 via the bolt connections in corresponding bolting points A, B, C and D (see FIG. 2) on the main jib head 2*a*.

Such main jib extensions 1 are fundamentally constructed as modular design systems from individual main elements and can be fitted together depending on the required length or load capacity thereof. The individual main elements have dimensions suitable for transportation and in most cases are not carried along with the telescopic crane but are transported separately. When the spindle loads of telescopic crane and the construction size of the main jib extension 1 allow, the main jib extension 1 can be carried along if required. This would then be located in a transportation position laterally next to and in parallel with the main jib 2. A connection of the individual main elements to one another to form the desired main jib extension 1 is effected via bolt connections. The attachment to the main jib head 2*a* can be effected using the main elements or as a premounted unit or units.

Figure 2:
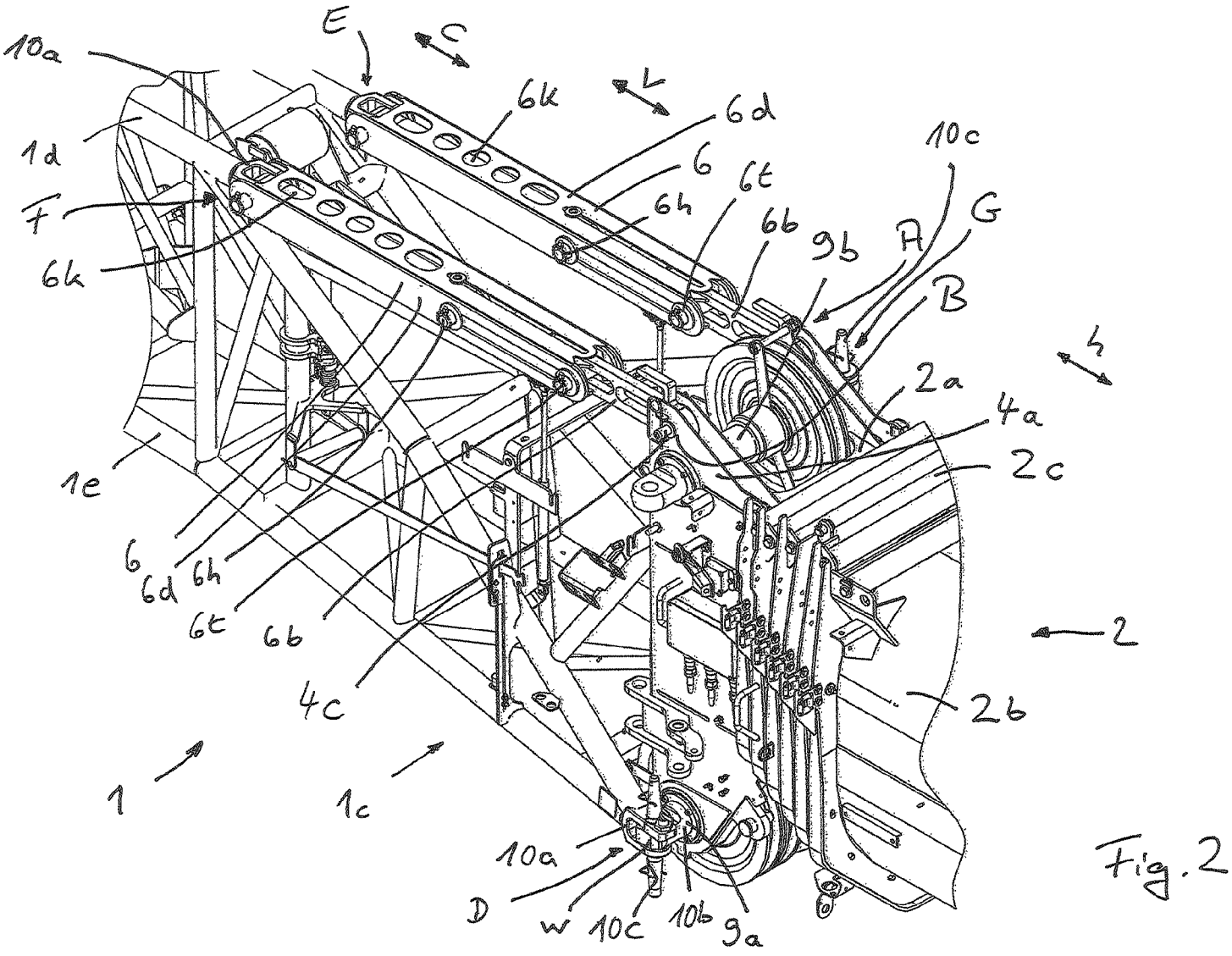
FIG. 2 is a detailed view of FIG. 1 from the region where the main jib extension is coupled onto the main jib.

FIG. 2 is a detailed view of FIG. 1 from the region where the main jib extension 1 is coupled onto the main jib 2. The main jib extension 1 comprising, in a conventional manner, a rectangular cross-section, is fastened via four bolt connections disposed in the corner regions of the main jib extension 4 to bolting points A, B, C and D on the main jib 2 and possibly an additional bolting point G. The lower right bolt connection at the bolting point C is concealed by the main jib 2 but is designed identically to the bolt connection at bolting point D.

The two lower bolt connections at bolting points C and D are designed as a so-called double shear bolt connection which in a corresponding manner is substantially made up of a fork plate 4*a*, a plate 4*b* and a bolt 4*c*. The fork plate 4*a* with its two opposing bores for the bolt 4*c* is fastened at each of the two bolting points C and D to a foot 1*c* of the main jib extension 1 and as an extension of the bottom chord 1*e* of the main jib extension 1. In this case the bores in the fork plate 4*a* are vertically orientated when the main jib extension 1 is horizontal. The plate 4*b* is fastened to the main jib head 2*a* via a lower roller head spindle 9*a*. When the main jib head 2*a* is orientated horizontally, the lower roller head spindle 9*a* is orientated horizontally and transversely to the longitudinal direction of the main jib 2 and is rotatably mounted in the main jib head 2*a*. In a corresponding manner, the plate 4*b* is in each case also rotatable about the horizontal lower roller head spindle 9*a*. The plate 4*b* also comprises a bore which is aligned with the bores in the fork plate 4*a* when the main jib extension 1 is in the attached position. A bolt 4*c* is inserted into the bores in the plate 4*b* and the fork plate 4*a* in order to fasten the main jib extension 1 to the main jib head 2*a* in a corresponding manner.

Instead of the lower roller head spindle 9*a* provided with this construction of the main jib 2, a spindle additionally provided for the attachment of the main jib extension 1 and being orientated and rotatable corresponding to the above-described roller head spindle 9*a* could also be provided. The plate 4*b* can also be fastened to the main jib head 2*a* directly and therefore in a non-rotatable manner. In order to achieve the luffability of the main jib extension 1 relative to the main jib 2, the bore for the bolts 4*c* in the plate 4*b* must then be orientated horizontally.

In the region of the top chord 1*b*, the attachment of the main jib extension 1 at bolting points A and B is effected indirectly via two combi-angling plates 6 extending in parallel with and spaced apart from each other in the region of the corners of the main jib extension 1. The combi-angling plates 6 are connected to the foot 1*c* of the main jib extension 1 at their end remote from the main jib head 2*a* via further bolt connections at bolting points E and F. In a so-called 0° position with respect to the angling angle b each of the two combi-angling plates 6 has the function of a rigid rod with in each case a connecting bore 6*r* at the end facing the main jib 2 and a connecting bore 6*s* at the end facing the main jib extension. The combi-angling plates 6 extend with their longitudinal directions c substantially in parallel with the longitudinal direction v of the main jib extension 1. The bolt connections at the bolting points A and B are designed as a so-called double shear bolt connection. In this case, a fork plate 4*a* is located on the main jib head 2*a* and a plate 4*b* is formed by one end of the combi-angling plate 6 in the region of the connecting bore 6*r*. The fork plate 4*a* comprises two opposing bores for the bolts 4*c*. In this case the bolts in the fork plate 4*a* are horizontally orientated when the main jib extension 1 is horizontal. The plate 4*b* also comprises a bore which is aligned with the bores in the fork plate 4*a* when the main jib extension 1 is in the attached position. A bolt 4*c* is inserted into the bores in the plate 4*b* and the fork plate 4*a* in order to fasten the main jib extension 1 to the main jib head 2*a* in a corresponding manner.

At the end opposite the main jib head 2*a* each of the combi-angling plates 6 is connected to the foot 1*c* of the main jib extension 1 via a further double shear bolt connection at bolting points E and F. Each of the two bolt connections is characterised by a fork plate 10*a* which is disposed on the foot 1*c* of the main jib extension 1 as an extension of the top chord 1*d*. The fork plate 10*a* is comparable to the fork plate 4*a* previously described in relation to the bottom chord 1*e* but the opposing bores of the fork plate 10*a* are not orientated vertically but horizontally. A plate 10*b* engaging into the fork plate 10*a* and likewise designed as a fork plate is disposed on the end of the combi-angling plate 6 facing the main jib extension 1. In a conventional manner, the fork plate 10*a* and the plate 10*b* are connected to one another via a bolt 10*c* which is horizontally orientated.

Furthermore, FIG. 2 shows that the combi-angling plate 6 consists of a sliding plate 6*b* and a guiding plate 6*d* which are pushed one inside the other and can be displaced oppositely to one another. In this case, the angling drive 6*j* in the sliding plate 6*b* is disposed between two sliding plate parts 6*b*' and 6*b*". As described above, the Figure shows the 0° position in which the sliding plate 6*b* and the guiding plate 6*d* are locked to one another via a locking bolt 6*t* and a stop bolt 6*h*.

Since the combi-angling plates 6 are each integrated into the foot 1*c* of the main jib extension 1, the bolting points C, D, E and F are located with the lower and upper fork plates 10*a* in a connecting plane tilted out of a vertical—as seen when the main jib extension 1 is orientated horizontally—towards the head if of the main jib extension 1. In other words, the top chords 1*d* at the foot 1*c* of the main jib extension 1 are shorter than the bottom chords 1*e* at the foot 1*c* of the main jib extension 1 and the upper fork plates 10*a* are set back with respect to the lower fork plates 10*a*. The foot 1*c*, thereby specially formed, of the main jib extension 1 can also be designed as a foot segment which can then be substantially adjoined by further cuboidal segments of the main jib extension 1.

In relation to other functions of the main jib extension 1 apart from the above-described anglabilty it can be advantageous, in addition to the above-described bolting points A to F, to provide a further bolting point G which, in the region of the top chord 1*d* of the main jib extension 1, is disposed in a vertical plane with the bolting points C and D and on one of the two sides of the main jib extension 1. This additional bolting point G can then, depending on the side, serve as a vertical spindle with one of the bolting points C and D in order to be able to fold a main jib extension 1 into a transportation position in a parallel manner next to the main jib 2.

In order to be able to angle the main jib extension 1 relative to the main jib head 2*a* or main jib 2, provision is made to pull the two upper locking bolts 6*t* at the bolting points A and B in the region of the top chord 1*d* of the main jib extension 1 or at the end facing the main jib head 2*a* and as an extension of the top chord 1*d* of the main jib extension 1 disposed combi-angling plates 6 [sic] so that the main jib extension 1 can be angled relative to the main jib 2 about the lower roller head spindle 9*a* in the region of the lower bolting points C and D in the region of the bottom chord 1*e* of the main jib extension 1 by the angling angle b. In addition, it may be necessary to pull a bolt 10*c* in an upper bolting point G on the right side of the main jib extension 1. This bolt 10*c* is required in order to be able to pivot the main jib extension 1 horizontally into a transportation position. The lower roller head spindle 9*a* therefore forms the luffing axis w. The angling angle b lies in a conventional manner in the range of 0° to 40°. In order to be able to delimit the angling angle b or to be able to adjust angling angles to the conventional values of 20° and 40°, the two length-modifiable combi-angling plates 6 are provided.

Figure 3:
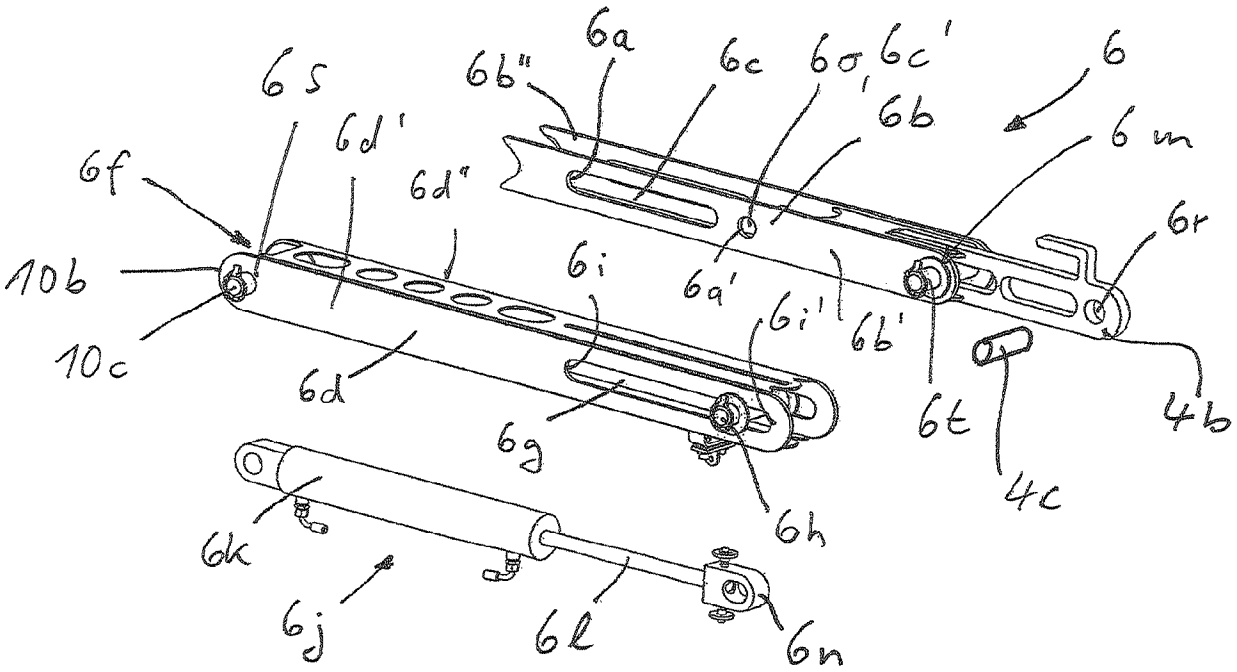
FIG. 3 shows an exploded view of a combi-angling plate of FIG. 2.

FIG. 3 shows an exploded view of a combi-angling plate 6. The active combi-angling plate 6 consists substantially of a sliding plate 6*b*, a guiding plate 6*d* and an angling drive 6*j*. The sliding plate 6*b*, which at its end facing the main jib head 2*a* comprises the plate 4*b* with the connecting bore 6*r*, begins with a flat profile shape at this end and, after approximately one quarter of its length, widens in the shape of a box with two mutually parallel and spaced apart flat-profile-shaped lateral sliding plate parts 6*b*', 6*b*". This box-like design is provided to receive the angling drive 6*j*, designed as a hydraulic cylinder, therebetween. Each of these sliding plate parts 6*b*', 6*b*" comprises, starting from the main jib head 2*a*, initially, a locking bore 6*m* for the 0° position of the main jib extension 1, spaced apart therefrom a bore-like first stop opening 6*c*' for a 20° position of the main jib extension 1, and again spaced apart therefrom a second elongate hole-like stop opening 6*c* for a 40° position of the main jib extension 1. The stop openings 6*c* and 6*c*' each comprise, at the side thereof facing the main jib extension 1, a semi-circular stop surface 6*a*, 6*a*' for a stop bolt 6*h*. The right locking bore 6*c*', 6*o* for the 0° position of the main jib extension 1 also serves as a bore for the releasable fastening of the free end of a rod 6*l* of the angling drive 6*j* provided the angling drive 6*j* is required. The locking bolt 6*t* illustrated in FIG. 3 in relation to the sliding plate 6*b* is required only in the 0° position of the main jib extension 1, is removed for the angling to begin and can, after completed slight angling of the main jib extension 1, be inserted, for storage purposes, into the locking bore 6*m* provided that the guiding plate 6*b* is no longer located with its stop opening 6 in the region of the locking bore 6*m*.

In addition to the sliding plate 6*b* a guiding plate 6*d* is also illustrated in which the sliding plate 6*b* is pushed and displaceably guided. In a corresponding manner, the guiding plate 6*d* is also designed in a box-like manner with a central right-angled guide opening 6*f* and mutually parallel and mutually spaced first and second guiding plate parts 6*d*' and 6*d*". An elongate hole-like stop opening 6*g* is provided in the guiding plate parts 6*d*' and 6*d*" disposed in an opposing relationship. The stop opening 6*g* comprises, at the ends, opposing stop surfaces 6*i*, 6*i*', on which the stop bolts 6*h* or the locking bolts 6*t* are in the 0°, 20° or 40° position.

Furthermore, FIG. 3 illustrates the angling drive 6*j* in the form of a single hydraulic cylinder with a housing 6*k* and a rod 6*l*. At the free end of the rod 6*l* is fastened a connection element 6*n* with a bore in order, if required, to connect the hydraulic cylinder via a stop bolt 6*h*, if required, to the locking bore 6*o* of the sliding plate 6*b*. At the opposite end, the housing 6*k* of the hydraulic cylinder is connected to the bolt 10*c* jointly with the guiding plate 6*d* at the stop point E or F on the plate of the foot 1*c* of the main jib extension 1. The hydraulic cylinder can be attached e.g. to existing hydraulic circuits. The hydraulic circuit of a drawing cylinder for horizontal pivoting of an entrained main jib extension from a transportation position is fundamentally suited to this purpose.

The angling drive 6*j* is dimensioned such that only the intrinsic weight of the main jib extension 1 can be angled up or down. Therefore, in the 0° position, the two combi-angling plates 6 form a part of the foot 1*c* of the main jib extension 1. As a result, the upper and lower bolting points A, B, C, D lie in a plane which extends vertically when the main jib extension 1 is orientated horizontally.

Figure 4A:
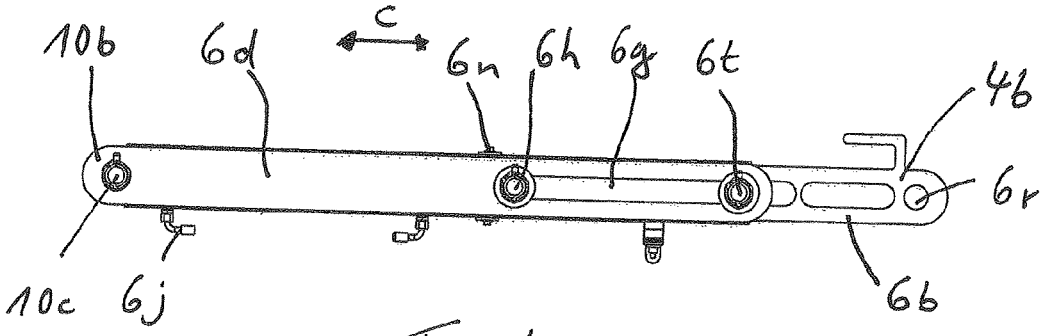
FIG. 4*a* shows a detailed view of a combi-angling plate in the position shown in FIG. 1.

FIG. 4*a* shows a detailed view of an assembled combi-angling plate 6 according to FIG. 2 in the locked 0° position. In the 0° position, the sliding plates 6*b* and the guiding plates 6*d* are fixed relative to the longitudinal direction c via a locking bolt 6*t* and a stop bolt 5*h*. The locking bolt 6*t* and the stop bolt 6*h* are inserted into the stop opening 6*g* and the locking bolt 6*t* lies against the front stop surface 6*i*' and the stop bolt 6*h* lies against the rear stop surface 6*i* (see FIG. 3). Already in the 0° position, the stop bolt 6*h* can already be engaged with the connection element 6*n* on the rod 6*l* of the hydraulic cylinder so that the angling drive 6*j* is already drivingly connected to the combi-angling plate 6.

Figure 4B:
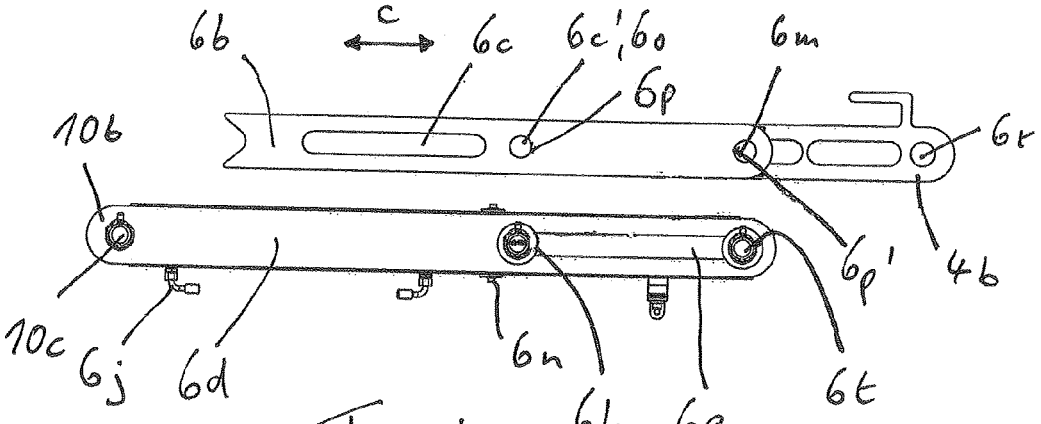
FIG. 4*b* shows a view of FIG. 4*a* with a sliding plate and guiding plate next to each other.

FIG. 4*b* illustrates a view according to FIG. 4*a*, in which the sliding plate 6*b* and guiding plate 6*d* have been separated and are therefore illustrated next to one another. This view shows clearly that in the 0° position the right locking bolt 6*t* and the left stop bolt 6*h* extend through the stop opening 6*g* in the guiding plate 6*d* through the locking bores 6*o*, 6*m*.

Angling of the main jib extension 1 located in the basic or 0° position according to FIG. 1 into a 40° position is explained with the aid of FIGS. 1 to 8, in particular FIGS. 5 to 8. In a first step, the angling drive 6*j*, which is fastened, with its housing 6*k*, to the fork plate 10*b* of the main jib extension 1, jointly with the guiding plate 6*b* via the bolts 10*c*, is connected to the sliding plate 6*b* provided that the angling drive 6*j* is not yet already connected thereto via the stop bolt 6*h*. For this purpose, the stop bolt 6*h* is pulled and the retracted angling drive 6*j* is extended until the bore in the connection element 6*n* is aligned with the locking bore 6*o* and the stop opening 6*g*. The stop bolt 6*h* is then inserted. This situation is illustrated in FIGS. 4*a* and 4*b*. The angling drive 6*j* is then actuated and the rods 6*l* of the hydraulic cylinder retracted so little that the sliding plates 6*b* are pulled relative to the guiding plates 6*d* in the direction of the main jib extension 1 and the distance between the bolting points A, B and E, F is reduced and the main jib extension 1 pivots slightly upwards over the lower roller head spindles 9*a* of the bolting points C, D, which are disposed in the region of the bottom chord 1*e*. In this way, the main jib extension 1 is lifted slightly so that the locking bolts 6*t* in the combi-angling plates 6 are relieved. The bolt 10*c* is also relieved at connection point G between the main jib extension 1 and the main jib head 2*a* which serves for pivoting into or out of the transportation position. This bolt 10*c* is also removed in the relieved 0° position so that it is not located within the subsequent force flow during load lifting. The now relieved locking bolts 6*t* and the bolt 10*c* at connection point G are then removed. The main jib extension 1 is now supported via the two lower bolts 4*c* in combination with the two combi-angling plates 6 on the main jib 1 and the angling drives 6*j*. The lower roller head spindle 9*a* therefore forms the luffing axis w for the angling of the main jib extension 1.

In a next step the angling drives 6*j* are actuated again and the rods 6*l* of the hydraulic cylinders are slowly extended. In this way the sliding plates 6*b* are pushed in the direction of the main jib 2 relative to the guiding plates 6*d* so that the distance between the bolting points E, F and A, B is increased and the main jib extension 1 pivots over the lower roller head spindle 9*e* of the bolting points C, D about the angling angle b, said roller head spindle being disposed in the region of the bottom chord 1*e*. By this angling movement the head 1*f* of the main jib extension 1 pivots in the direction of the ground surface 3 until it contacts the ground surface 3.

Figure 5:
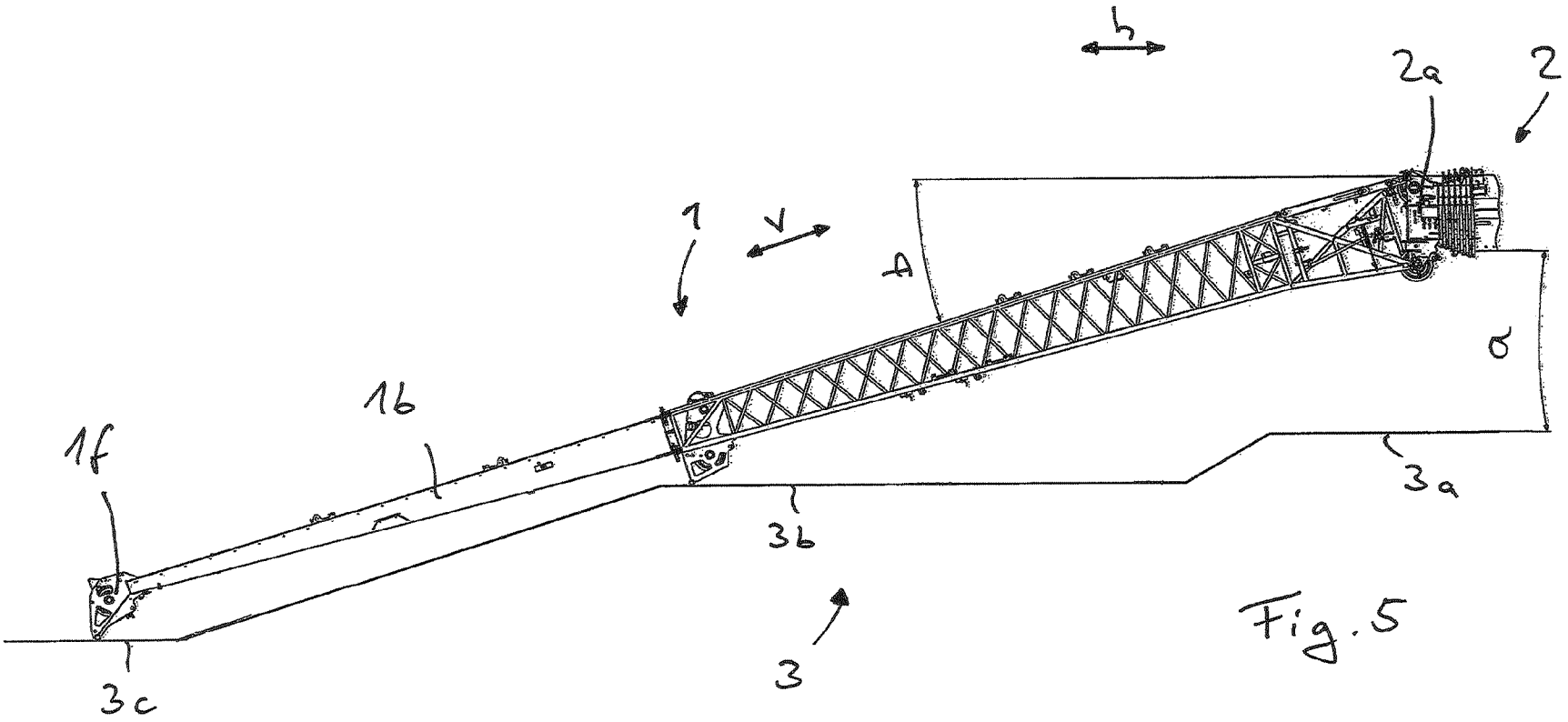
FIG. 5 shows the main jib of FIG. 1 with the main jib extension in a 15° position.

FIG. 5, which illustrates the main jib extension 1 according to FIG. 1 in a 15° position, shows the position described above in which the lowered head 1*f* is supported on the ground surface 3 but the angling drive 6*j* is still coupled. The luffing angle a of the main jib 2 continues to be 0°.

Figure 6A:
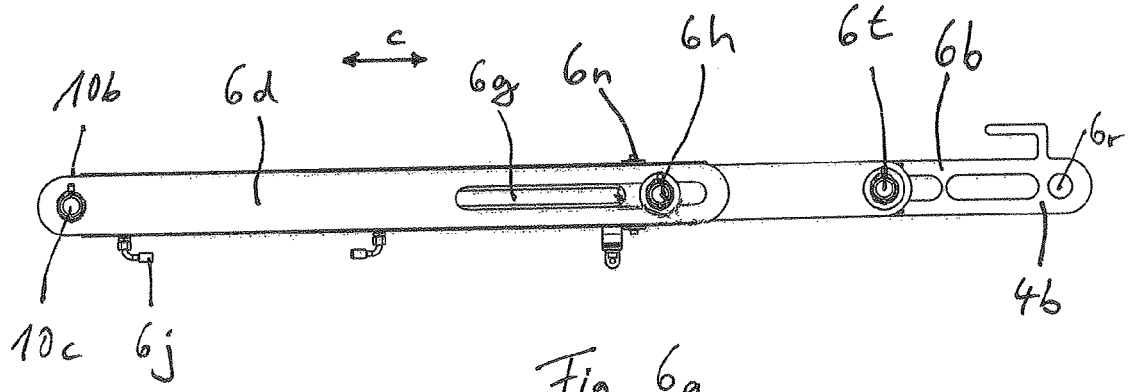
FIG. 6*a* shows a detailed view of a combi-angling plate in the position shown in FIG. 5.

FIG. 6*a* shows a detailed view of a combi-angling plate 6 in the 15° position shown in FIG. 5. It shows that the rod 6*l* of the hydraulic cylinder is extended a long way and the connection element 6*n* continues to be connected via the stop bolt 6*h* to the sliding plate 6*b*.

Figure 6B:
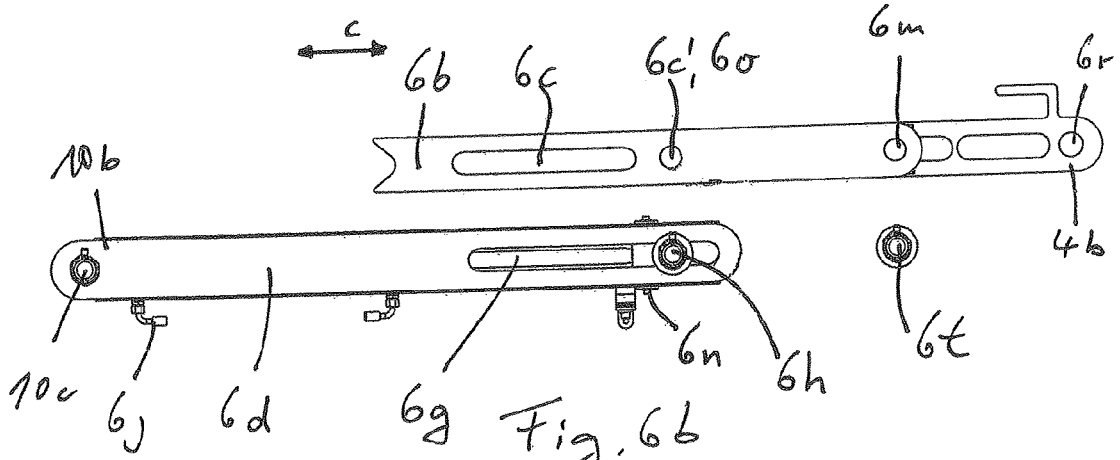
FIG. 6*b* shows a side view of FIG. 6*a* with a sliding plate and guiding plate next to each other.

FIG. 6*b* illustrates a view according to FIG. 6*a*, in which the sliding plate 6*b* and guiding plate 6*d* have been separated and are therefore illustrated next to one another. This view shows clearly that in the 15° position the right locking bolt 6*t* is inserted only for storage purposes and has no function and the left stop bolt 6*h* extends through the stop opening 6*g* in the guiding plate 6*d* through the locking bore 6*o* and couples the angling drive 6*j* via the connection element 6*n* thereof.

Figure 7:
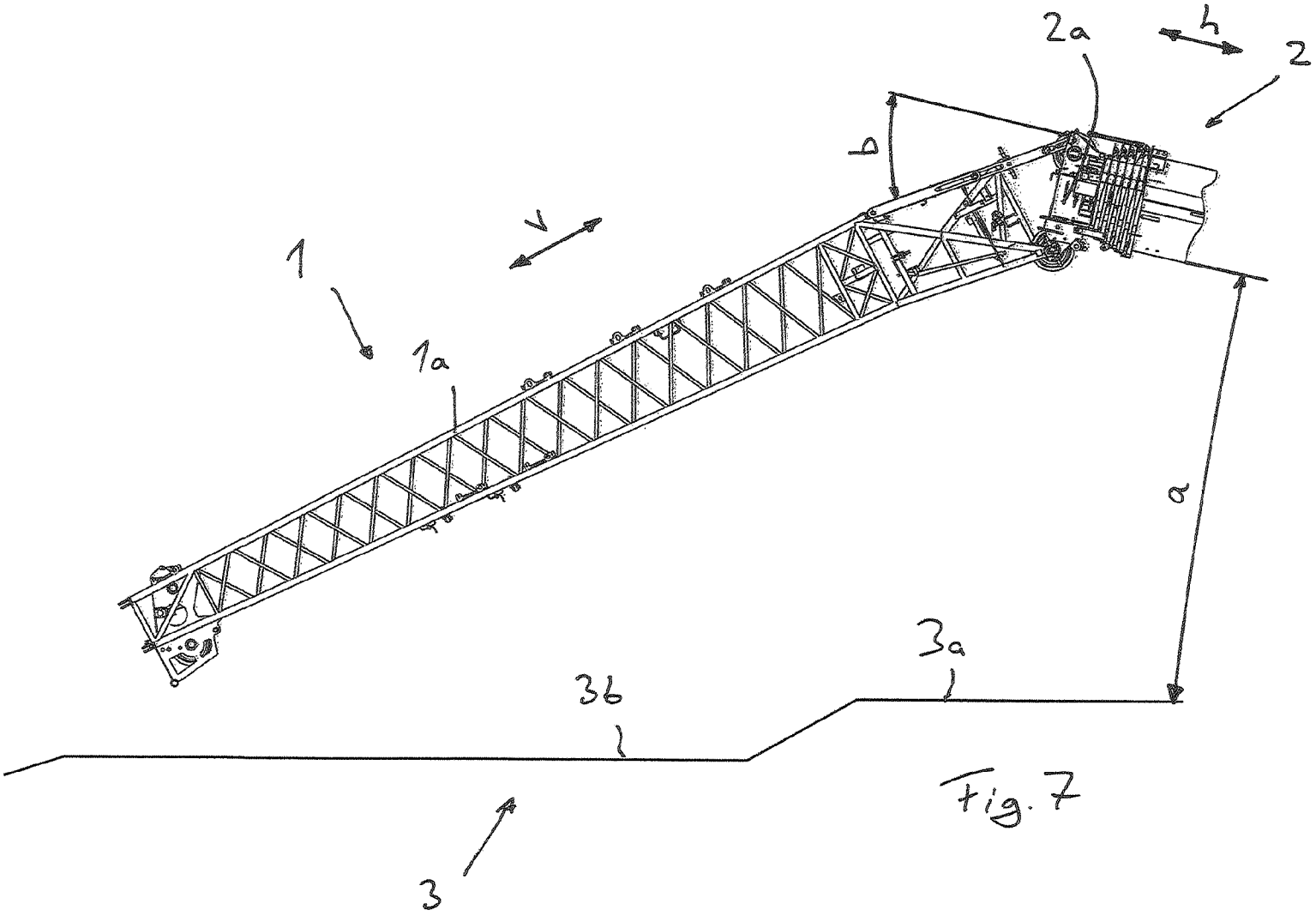
FIG. 7 shows the main jib of FIG. 1 with the main jib extension in a 40° position.

In a further step the angling drive 6*j* is now extended a little further, whereby the stop bolts 6*h* in the locking bores 6*o* are relieved and then pulled. The decoupled rods 6*l* of the angling drives 6*j* are then completely retracted and the stop bolts 6*h* are inserted through the stop opening 6*g* in the guiding plate 6*d* into the stop opening 6*c*' of the sliding plate 6*b* for the 20° position or into the stop opening 6*c* of the sliding plate 6*b* for the 40° position. In the present case, the stop opening 6*c* of the sliding plate 6*b* is selected for the 40° position. By luffing-up the main jib 2 about the luffing angle a the main jib extension 1 is now angled further and the tip 1*f* of the main jib extension 1 slides therethrough over the ground surface 3 in the direction of the main jib 2. By the luffing-up action the main jib extension 1 is further angled until the combi-angling plates 6 delimit the angling in the preselected position. At the time of delimitation of the angling movement in the 40° position by the combi-angling plates 6 the tip 1*f* still has contact with the ground surface 3. During further luffing-up of the main jib 1, the main jib extension 1 is then lifted from the ground surface 3 in the 40° position. This position, in which the main jib extension 1 is located in a 40° position relative to the main jib 2, is illustrated in FIG. 7. For the sake of clarity, the tip 1*b* of the main jib extension 1 is not shown therein.

Figure 8A:
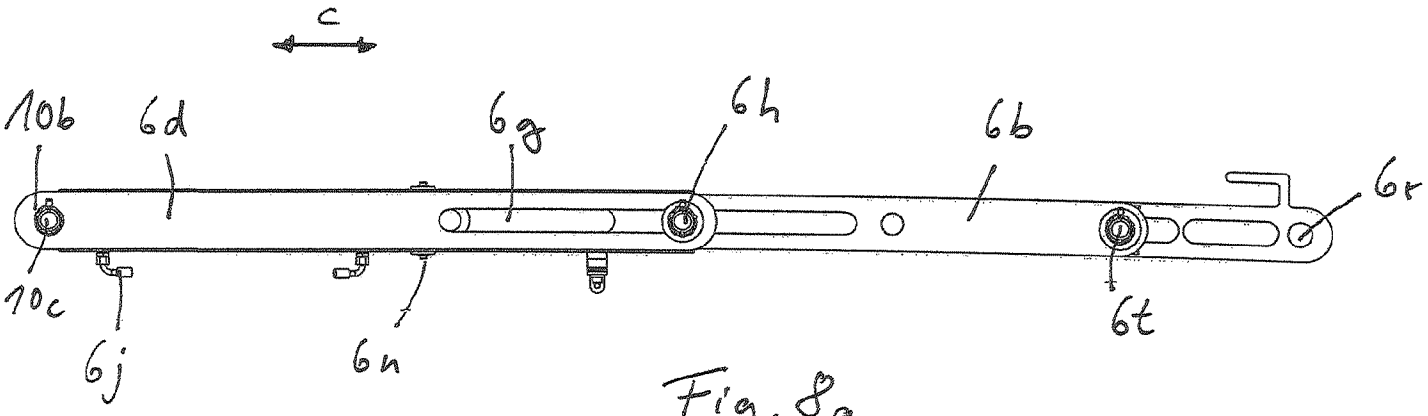
FIG. 8*a* shows a detailed view of a combi-angling plate in the position shown in FIG. 7.

FIG. 8*a* shows a detailed view of a combi-angling plate 6 in the position shown in FIG. 7. The stop bolt 6*h* lies in the stop opening 6*g* on the right stop surface 6*i*' which faces the main jib head 2*a*. The stop bolt 6*h* also lies against the left stop surface 6*a*' of the sliding plate 6*b*. In this way the maximum displaceability of the guiding plate 6*d* on the sliding plate 6*b* is delimited. This corresponds to an angling angle of 40°.

Figure 8B:
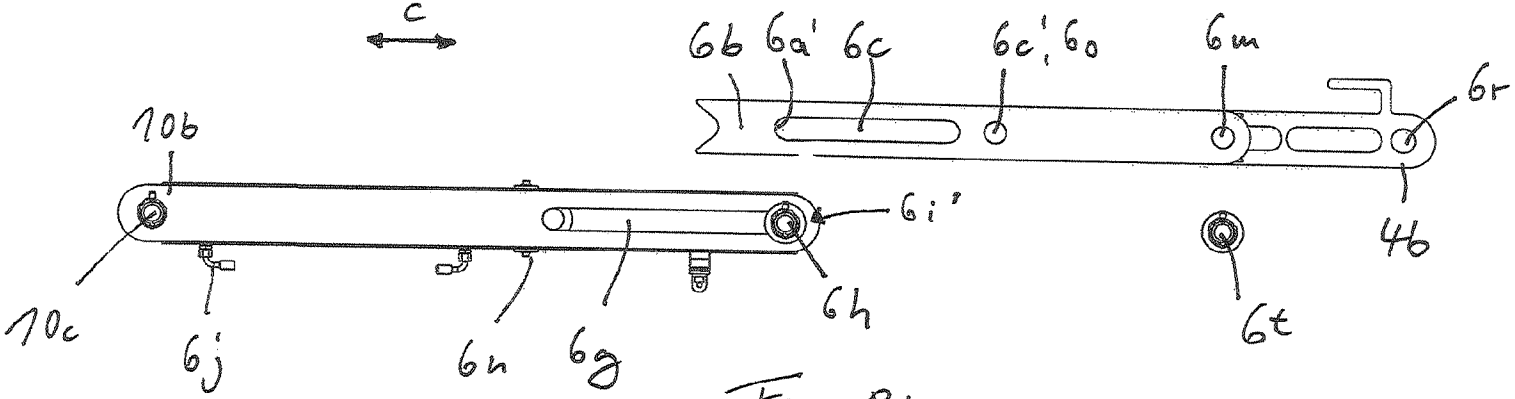
FIG. 8*b* shows a side view of FIG. 8*a* with a sliding plate and guiding plate next to each other.

FIG. 8*b* illustrates a view according to FIG. 8*a*, in which the sliding plate 6*b* and guiding plate 6*d* have been separated and are therefore illustrated next to one another. This view clearly shows that the angling drive 6*j* is further decoupled since the connection element 6*n* is removed from the stop bolt 6*h*.

Setting back or upwardly angling the main jib extension 1 takes place in the reverse order.

Although in conjunction with the present exemplified embodiment, the main jib 2 is described as a telescopic jib and the main jib extension 1 as a lattice mast jib with a box tip, the invention can also be applied to other embodiments of main jibs 2 and main jib extensions 1. The main jib 2 can also be a lattice mast jib or a combination of a telescopic jib, lattice mast jib and/or box jib. For the main jib extension 1, lattice mast jibs or box jibs or combinations thereof are feasible.

The use of an individual combi-angling plate 6 disposed centrally in relation to the width of the top chord 1*d* of the main jib extension 1 is feasible. Furthermore, the combi-angling plate 6 has thus far been described as a tension rod. An embodiment as a compression rod is also possible, as is an arrangement in the bottom chord region. It is also feasible for the luffing axis w then to be disposed in the region of the top chord 1*d*. The foot 1*c* of the main jib extension 1 is correspondingly chamfered, preferably in the form of an adapter in order to permit angling of the main jib extension 1 about the upper luffing axis w.

The invention claimed is:

1. A mobile crane with a main jib luffably mounted thereon and able to be raised via a luffing cylinder, and with a main jib extension releasably connected to a main jib head of the main jib via upper and lower bolts, the main jib extension, starting from a basic position, is able to be angled about a luffing axis relative to the main jib by an angling drive, wherein the angling drive is a component of a combi-angling plate which delimits a maximum angling angle in a mechanically adjustable manner, and wherein the angling drive engages on a foot of the main jib extension and the main jib head and the combi-angling plate comprises a sliding plate, a guiding plate and the angling drive, and wherein the combi-angling plate can be modified in length via the angling drive and the angling drive drivingly engages on the one hand on the sliding plate and on the other hand on the guiding plate, and wherein the sliding plate can be displaced in a length-modifiable manner relative to the guiding plate via the angling drive, wherein the combi-angling plate on the one hand engages on the main jib head and on the other hand on the main jib extension, wherein the sliding plate is displaceably guided in the guiding plate and the angling drive is disposed in the guiding plate.

2. The mobile crane as claimed in claim 1, wherein the angling drive is releasably fastened to the sliding plate.

3. The mobile crane as claimed in claim 2, via a stop bolt, a maximum displacement of the sliding plate relative to the guiding plate can be delimited.

4. The mobile crane as claimed in claim 3, wherein the luffing axis is formed in the region of the top chord of the main jib extension or of the bottom chord of the main jib extension and wherein the combi-angling plate is disposed in the region of the bottom chord of the main jib extension or of the top chord of the main jib extension.

5. The mobile crane as claimed in claim 4, wherein the angling drive is designed such that the main jib extension can be lifted and lowered in a pivoting manner about the luffing axis against the effect of the gravitational force of the main jib extension.

6. The mobile crane as claimed in claim 5, wherein the angling drive is designed as a hydraulic cylinder with a housing and a rod.

7. The mobile crane as claimed in claim 6, wherein two combi-angling plates are disposed in parallel and spaced apart from one another and the two combi-angling plates are preferably disposed in corner regions of the main jib extension.

8. The mobile crane as claimed in claim 7, wherein the combi-angling plate replaces a part of the top chord or of the bottom chord of the main jib extension in the region of the foot of the main jib extension.

9. The mobile crane as claimed in claim 8, wherein the sliding plate is pivotably mounted on the main jib head, the guiding plate is pivotably mounted on the main jib extension and by an insertable stop bolt a maximum displacement of the sliding plate in the guiding plate can be delimited.

10. The mobile crane as claimed in claim 1, via a stop bolt, a maximum displacement of the sliding plate relative to the guiding plate can be delimited.

11. The mobile crane as claimed in claim 1, wherein the luffing axis is formed in the region of the top chord of the main jib extension or of the bottom chord of the main jib extension and wherein the combi-angling plate is disposed in the region of the bottom chord of the main jib extension or of the top chord of the main jib extension.

12. The mobile crane as claimed in claim 1, wherein the angling drive is designed such that the main jib extension can be lifted and lowered in a pivoting manner about the luffing axis against the effect of the gravitational force of the main jib extension.

13. The mobile crane as claimed in claim 1, wherein the angling drive is designed as a hydraulic cylinder with a housing and a rod.

14. The mobile crane as claimed in claim 1, wherein two combi-angling plates are disposed in parallel and spaced apart from one another and the two combi-angling plates are preferably disposed in corner regions of the main jib extension.

15. The mobile crane as claimed in claim 1, wherein the combi-angling plate replaces a part of the top chord or of the bottom chord of the main jib extension in the region of the foot of the main jib extension.

16. The mobile crane as claimed in claim 1, wherein the sliding plate is pivotably mounted on the main jib head, the guiding plate is pivotably mounted on the main jib extension and by an insertable stop bolt a maximum displacement of the sliding plate in the guiding plate can be delimited.

* * * * *